US005671876A

United States Patent [19]

Gardner

[11] Patent Number: 5,671,876

[45] Date of Patent: Sep. 30, 1997

[54] SOCK ORGANIZER

[76] Inventor: Trevis Daniell Gardner, 418 Montgomery St., Prichard, Ala. 36610

[21] Appl. No.: 79,934

[22] Filed: Jun. 23, 1993

[51] Int. Cl.[6] ..... A41H 43/00; A44B 1/00; A41F 1/00

[52] U.S. Cl. ..... 223/1; 24/336; 24/519; 24/543

[58] Field of Search ..... 24/335, 336, 519, 24/543; 223/1, DIG. 2

[56] References Cited

U.S. PATENT DOCUMENTS

| | | | |
|---|---|---|---|
| 3,204,636 | 9/1965 | Kariher et al. | 24/543 |
| 3,551,965 | 1/1971 | Gordon | 24/543 |
| 3,825,012 | 7/1974 | Nicoll | 24/543 |
| 3,854,482 | 12/1974 | Laugherty et al. | 24/543 |
| 5,226,892 | 7/1993 | Boswell | 24/543 |

*Primary Examiner*—Clifford D. Crowder
*Assistant Examiner*—Bibhu Mohanty

[57] ABSTRACT

The sock organizer is made from molded polycarbonate plastic from a die. The sock organizer is suitable for use in the water and heat in a washing machine. The sock organizer includes a clamp like device with a plurality of parallel finger elements to grasp socks therebetween. The clamp has two sides that are shut to secure the socks in place. The sock organizer may be placed directly from the washer to the dryer to keep the socks organized during the laundry process.

1 Claim, 3 Drawing Sheets

SOCK ORGANIZER

BACKGROUND OF THE INVENTION

This invention relates to clamps to keep socks together during the process of washing and drying. The device is made from plastic material to resist heat and water during washing. The device will clamp socks together during the washing process.

SUMMARY OF THE INVENTION

The sock organizer is made from molded polycarbonate plastic from a die. The sock organizer is suitable for use in the water and heat in a washing machine. The sock organizer includes a clamp like device with a plurality of parallel finger elements to grasp socks therebetween. The clamp has two sides that are shut to secure the socks in place. The sock organizer may be placed directly from the washer to the dryer to keep the socks organized during the laundry process.

DETAILED DESCRIPTION OF THE PREFERRED EMBODIMENT

Figure 1:
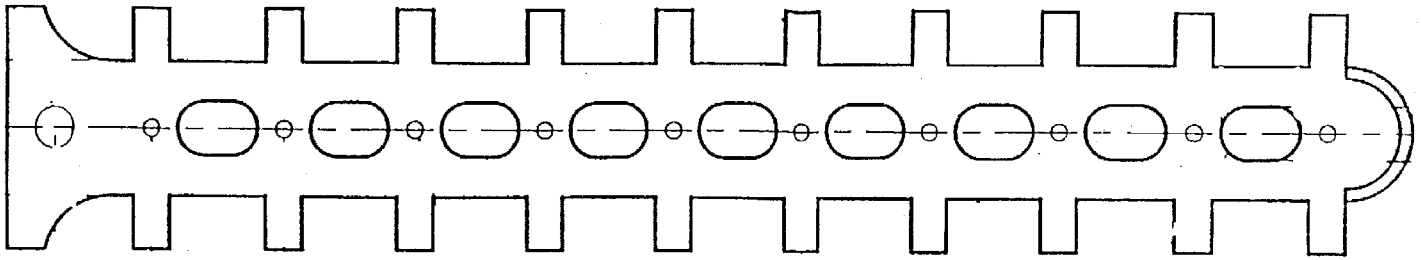
FIG. 1 shows a perspective view of the device.
Figure 2:
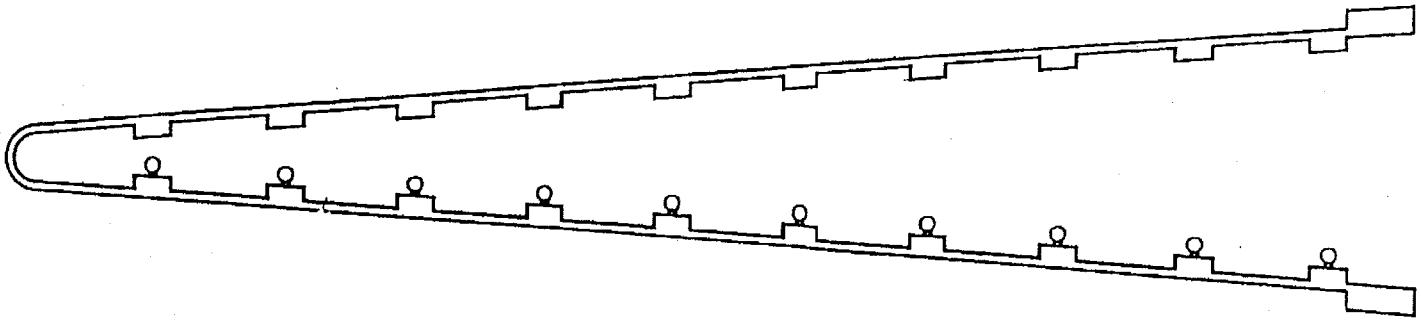
FIG. 2 shows the device with socks attached.
Figure 4:
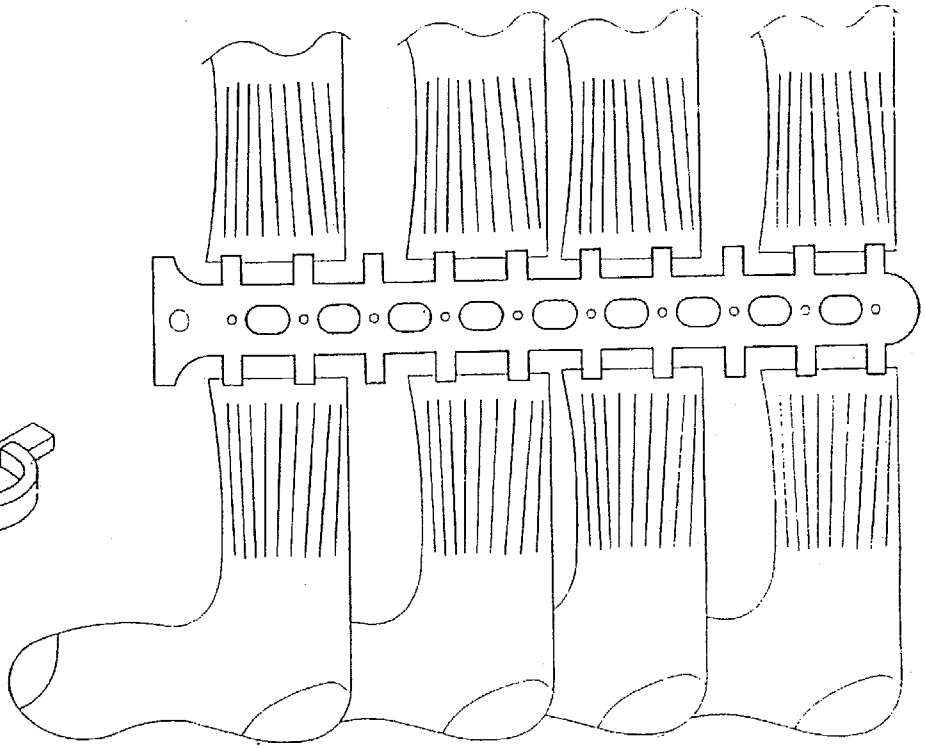
FIG. 4 shows a side view of the device.
Figure 3:
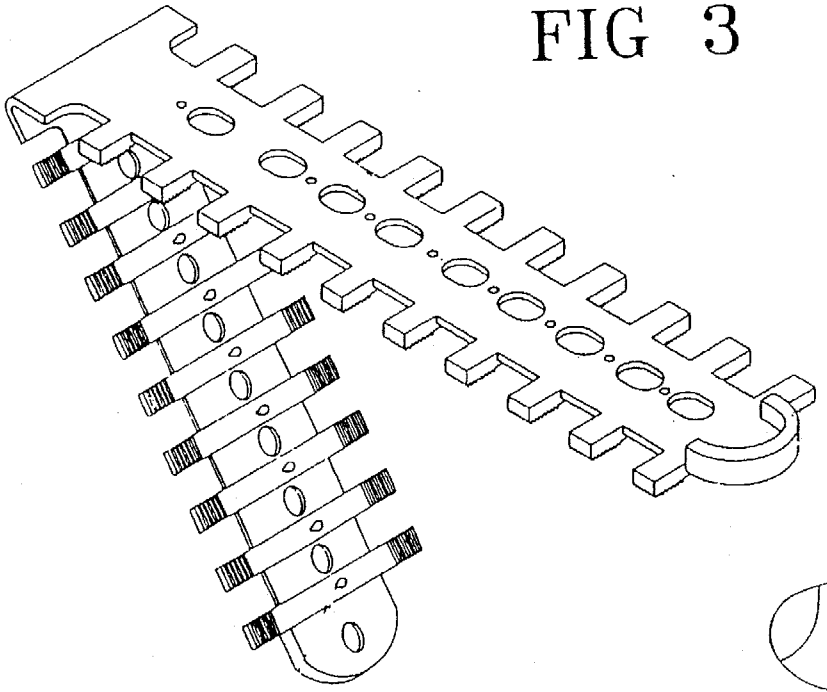
FIG. 3 shows a top view of the device.
Figure 7:
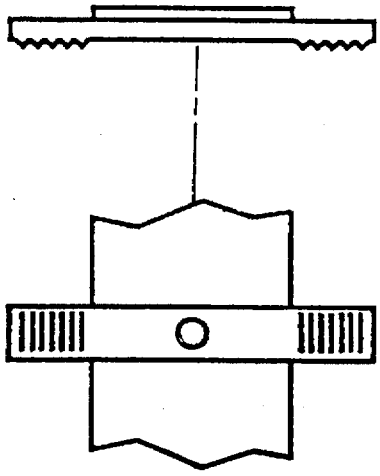
FIG. 5–7 shows the structure of the locking detent.
Figure 6:
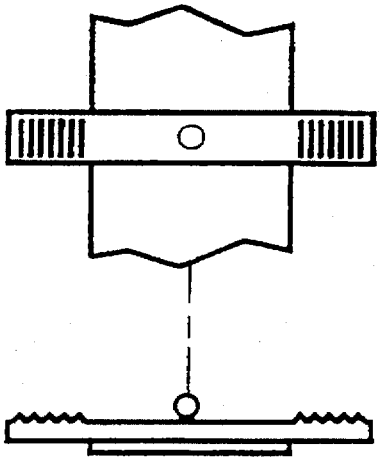
Figure 5:
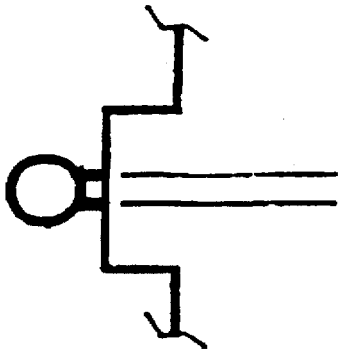

The sock organizer is a clamping device for socks. Made of plastic it is flexible and durable for exposure to both heat and water. The sock organizer is a molded body with fingers on the ends to retain the socks in place. A molded hinge makes the device easy to carry. A lock clip and thumb release opens the device to place the socks in. The sock organizer remains securely closed until opened.

The device (1) has substantially a V-shape with two mating laterally extending side members (2, 3) connected by an integral hinge (4). Each side member has a pair of parallel edges and a plurality of parallel finger elements (6) placed across extending laterally thereon. Each finger element include lateral ends (7) with knurled teeth thereon. A detent lock (8) is mounted on each finger element on one side member and a mating detent lock (9) mounted on each finger element of the other side member. A separate, adjacent, clearance hole (10) for wash agitation is placed between each adjacent side member. The parallel finger elements on each side member are in mating relationship. The sock organizer includes a finger pull (11) adjacent the end of the side members.

I claim:

1. A sock organizer for gripping pairs of socks during washing in a washing machine comprising: a molded plastic clamp having substantially a V-shape with two mating laterally extending side members connected by an integral hinge, each side member having a pair of parallel edges, each side member including a plurality of parallel finger elements placed across each side member and extending laterally from each side member, each finger element including lateral ends with knurled teeth thereon, a detent lock mounted on each finger element on one side member and a mating detent lock mounted on each finger element of the other side member, a separate, adjacent, clearance hole for wash agitation between each adjacent side member, wherein the parallel finger elements on each side member are in mating relationship, the sock organizer further comprising a finger pull adjacent the end of said side members.

* * * * *